US007673403B2

(12) United States Patent
Bridges

(10) Patent No.: US 7,673,403 B2
(45) Date of Patent: Mar. 9, 2010

(54) METHOD AND APPARATUS FOR UNASSISTED IMPLEMENT CONNECTION

(76) Inventor: Thomas Edward Bridges, 231 Lemay La., Willis, TX (US) 77378

( * ) Notice: Subject to any disclaimer, the term of this patent is extended or adjusted under 35 U.S.C. 154(b) by 433 days.

(21) Appl. No.: 11/449,513

(22) Filed: Jun. 8, 2006

(65) Prior Publication Data

US 2007/0289172 A1 Dec. 20, 2007

(51) Int. Cl.
*E02F 3/96* (2006.01)

(52) U.S. Cl. ..... 37/403; 37/446

(58) Field of Classification Search ..... 37/446, 37/403, 468, 404, 405, 406, 407
See application file for complete search history.

(56) References Cited

U.S. PATENT DOCUMENTS

| | | | | | |
|---|---|---|---|---|---|
| 2,303,415 | A | * | 12/1942 | Williams | 37/301 |
| 3,281,972 | A | * | 11/1966 | Kerestes | 37/446 |
| 3,921,837 | A | * | 11/1975 | Vandewater | 414/24.5 |
| 4,242,035 | A | * | 12/1980 | Hornstein | 414/724 |
| 4,360,980 | A | * | 11/1982 | Jarvis | 37/404 |
| 4,372,063 | A | | 2/1983 | Work | |
| 4,407,080 | A | | 10/1983 | Mann | |
| 4,411,585 | A | * | 10/1983 | Quinn | 414/724 |
| 4,550,512 | A | * | 11/1985 | Felstet | 37/403 |
| 5,141,385 | A | | 8/1992 | Tibbatts et al. | |
| 5,253,449 | A | * | 10/1993 | Webb et al. | 37/446 |
| 5,553,408 | A | * | 9/1996 | Townsend | 37/406 |
| 5,775,013 | A | * | 7/1998 | Von Schalscha | 37/407 |
| 5,915,837 | A | | 6/1999 | Brown et al. | |
| 6,088,938 | A | * | 7/2000 | Logan | 37/468 |
| 6,088,939 | A | * | 7/2000 | Logan | 37/468 |
| 6,098,321 | A | * | 8/2000 | Logan | 37/409 |
| 6,230,424 | B1 | * | 5/2001 | Renski et al. | 37/446 |
| 6,243,975 | B1 | * | 6/2001 | Gall | 37/407 |
| 6,434,865 | B2 | * | 8/2002 | Renski et al. | 37/446 |
| 6,523,284 | B1 | * | 2/2003 | Clugston | 37/403 |
| 6,709,224 | B2 | | 3/2004 | Heiple | |
| 2001/0045031 | A1 | * | 11/2001 | Holmes et al. | 37/407 |

* cited by examiner

*Primary Examiner*—Thomas B Will
*Assistant Examiner*—Jamie L McGowan
(74) *Attorney, Agent, or Firm*—John F. Bryan

(57) ABSTRACT

The present invention discloses an earth moving or similar machine having an operator positionable primary implement having symmetrically aligned and horizontally opposite connecting bosses for connecting to a secondary implement having upwardly extending hook members, each with an open face, and ramp portions leading from the open face to seat portion and a recurved point, extending toward the ramp portion, so that the machine operator can connect the hook members to the connecting bosses by maneuvering the machine and positioning the primary implement.

8 Claims, 3 Drawing Sheets

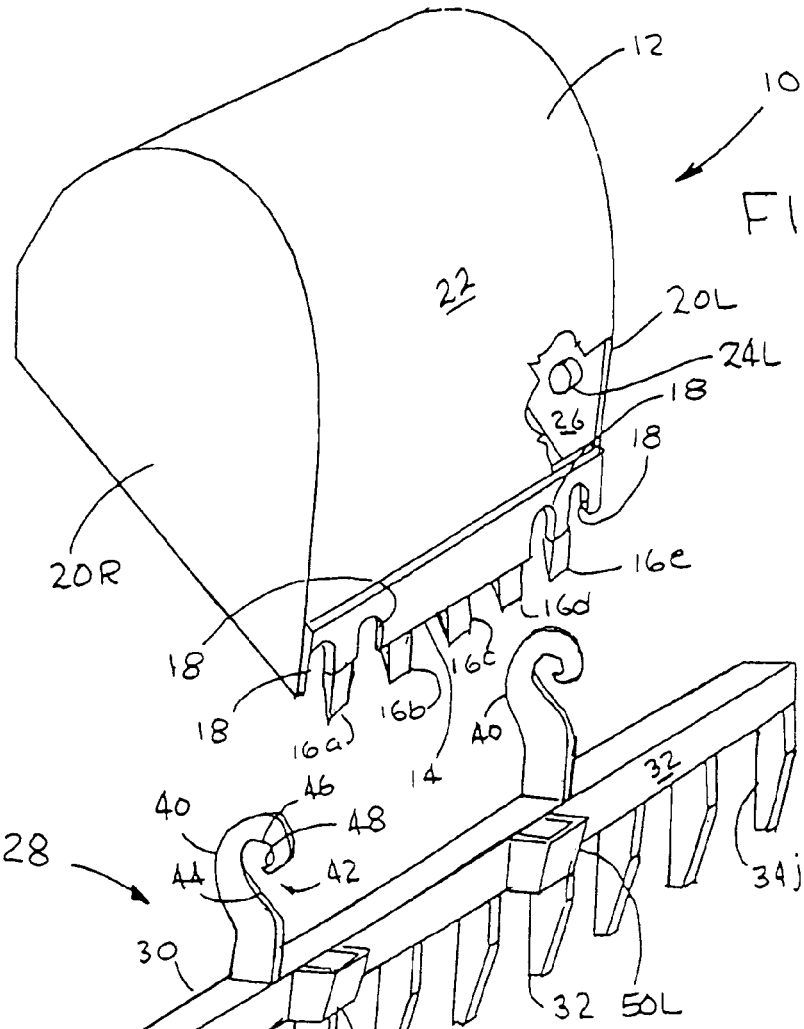
FIG. 1
FIG. 2
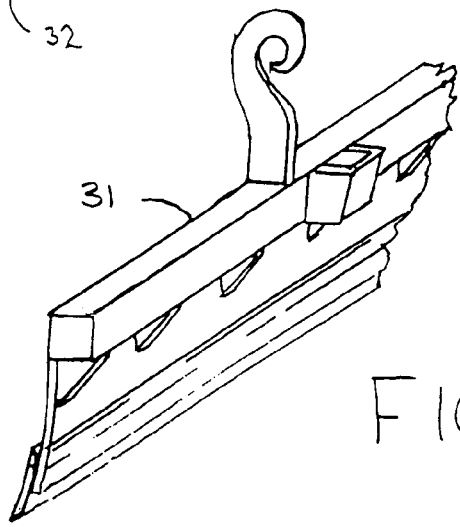
FIG. 2A

METHOD AND APPARATUS FOR UNASSISTED IMPLEMENT CONNECTION

TECHNICAL FIELD

The present invention relates generally to the field of earth moving and similar heavy equipment and more particularly, to the the connection of implements for various tasks to such equipment.

BACKGROUND

Heavy equipment as used for earth moving and similar applications may be used to perform a number of different functions using a variety of specially adapted implements, such as buckets, scarifying teeth, fork lift blades, smoothing blades or rakes. Most commonly, a bucket is the basic implement but it is often desirable to utilize the prime mover for other functions, so as to require the connection of an implement specifically adapted to the desired function. Thus, the ability to connect an implement quickly with a minimum of effort is highly desirable and can add significantly to the work potential of a machine.

In current practice, these implement change-overs require either on-ground assistance, for aligning connecting holes and driving, pins or the addition of complex, hydraulic power operated, coupling linkages. As a result, the cost of the desired flexibility can be such that there are other, less expensive alternatives for accomplishing the required function.

A first object of the present invention is therefore, to provide a method and apparatus that will enable the heavy equipment operator to connect attachments to his machine without assistance from on the ground. A second object is that the aforesaid method and apparatus be simple and inexpensive and yet a third object is that this method and apparatus be reliable and require little or no maintenance.

SUMMARY OF THE INVENTION

The present invention relates to or employs some steps and apparatus well known in the heavy equipment arts and therefore, not the subject of detailed discussion herein. This invention addresses the aforesaid objectives for connecting a secondary implement to an earth moving machine or similar by providing the secondary implement with a symmetrical set of upwardly extending connecting arms. The connecting arms terminate in elongated, open hooks. The machine operator maneuvers a pair of horizontally opposed bosses, affixed to a positionable portion of the machine, generally a primary implement, so that the bosses each couple with an open hook. The secondary implement is equipped with at least one pocket, located to engage a lower extension of the positionable portion or primary implement, as a means for orienting the implement for coupling the bosses and open hooks and for retaining the secondary implement after connection. The secondary implement may be a rake, a smoothing blade, a fork lift or any implement attachment needed for occasional use.

Each open hook includes a ramp leading from the open face to a seat, an inwardly curved point extending toward the ramp and opposing the seat, so that the connecting bosses engage the seats when connected and the inwardly curved points prevent disengagement in a generally vertical direction.

BRIEF DESCRIPTION OF THE DRAWINGS

The accompanying drawings are incorporated into the specification to assist in explaining the present invention. The drawings illustrate preferred and alternative examples of how the invention can be made and used and are not to be construed as limiting the invention to only those examples illustrated and described. The various advantages and features of the present invention will be apparent from a consideration of the drawings in which:

FIG. 1 is a perspective view of a bucket of a first embodiment of the present invention, shown as being representative of any of the primary implements generally used on heavy work equipment:

FIG. 2 is a secondary implement provided as a rake or scarifying attachment according to the present invention, shown in an appropriate position on the page relative to FIG. 1 as it would be prior to connection;

FIG. 2A shows the attachment of FIG. 2 reconfigured as a smoothing blade;

DETAILED DESCRIPTION OF THE DRAWINGS

Figure 3:
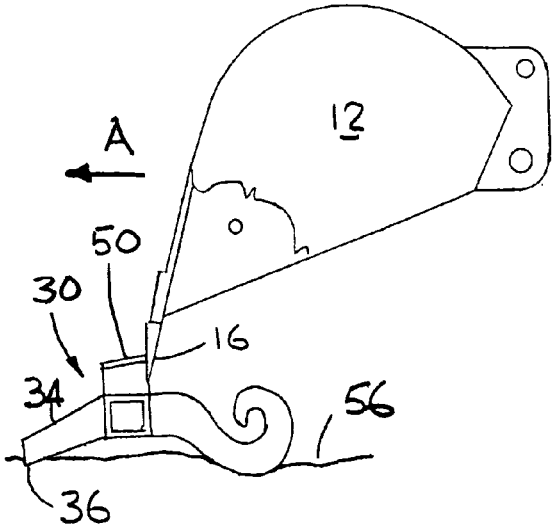
FIG. 3 shows the secondary implement of FIG. 2 as it appears when being approached by the primary implement of FIG. 1.

The present invention is described in the following by referring to drawings of examples of how the invention can be made and used. In these drawings, reference characters are used throughout the views to indicate corresponding parts. The embodiment shown and described herein is exemplary. Many details are well known in the art, and as such may be neither shown nor described. This invention teaches a way for a machine operator to connect an alternate implement to his machine quickly and without assistance.

Referring now to FIG. 1: here, the first component, or primary implement 10, of this preferred embodiment of the present invention is shown as back hoe bucket 12. It is to be understood that a front end loader bucket or bull dozer blade can be conformed in a similar manner in alternative embodiments for practicing the present invention. Bucket 12 comprises bucket edge 14, with a plurality of spaced apart, extending teeth 16*a*-16*e*, noting that the number of teeth may vary according to the size and design of bucket 12 . In this preferred embodiment, blade edge 14 is interrupted by relief gaps 18, at either side of outside teeth 16*a* and 16*e*, those nearest bucket sides 20R and 20L, but any set of symmetrically located teeth, or a single tooth, could serve as well. Also shown, by the break-out section in bucket bottom 22, is connecting boss 24L welded to the inner surface 26L of bucket side 20L in axial alignment with symmetrically opposite but unshown connecting boss 24R. Connecting bosses 24 could alternatively be welded to the exterior surfaces of bucket sides 20 but, at that location, would be forced against unbroken material during normal digging functions. This would be workable, but would create undesirable drag and wear. Thus, it is preferred to place them on the inner surfaces 26 where they are exposed only to broken and loose material.

In FIG. 2: here, secondary implement 28, of this embodiment of the present invention is shown as rake or scarifying attachment 30, according to the number, size and strength of picks 34, although other implements may be attached to primary implement 10 in a like manner. Should the number of picks be so great as to constitute a continuum, as shown in FIG. 2A, attachment 30 would become smoothing blade 31. It should be noted that FIGS. 1 and 2 are shown on the page in relative orientation as they will be upon connection. Lateral member 32 provides the basic structure for attachment 30 and the mounting picks 34*a*-34*j*, as the working elements thereof. Picks 34 terminate in ground engaging tips 36. When attachment 30 is in a working position, a pair of symmetrically positioned, open connecting hooks 40, spaced to fit between bucket sides 20, extend upwardly from lateral member 32. Open hooks 40, each include an open face 42, a ramp 44 leading upward from open face 42 to a seat 46 and an inwardly curved point 48 extending back toward ramp 44. Seats 46 engage connecting bosses 24 and Inwardly curved points 48 extend to prevent disengagement of connecting bosses 24 from seats 46 when attachment 30 is connected and held in a generally vertical orientation. Pockets 50R and 50L are affixed to lateral member 32, located to engage extended teeth 16*a* and 16*e* respectively. It is notable that relief gaps 18, at each side of bucket teeth 16*a* and 16*e* of FIG. 1, are arranged to allow tooth members 16*a* and 16*e* to extend deeply into pockets 50R and 50L. As shown in phantom lines in FIG. 1, this allows hook openings 42 to reach alignment with connecting bosses 24 as any secondary implement 28 is being connected with primary implement 10.

FIG. 3 shows attachment 30, the secondary implement of this preferred embodiment of the present invention, lying on the ground 56, with pockets 50 facing upward. Bucket 12, the primary implement of this preferred embodiment of the present invention, is shown above attachment 30, with teeth 16*a* and 16*e* aligned with pockets 50. As the operator inches the machine forward or rolls bucket 12 so that it is moved in the direction of arrow A, the tips 36 of picks 34 dig into ground 56 and attachment 30 is brought to the erect position of FIG. 4, with open hooks 40 extending upwardly.

Figure 4:
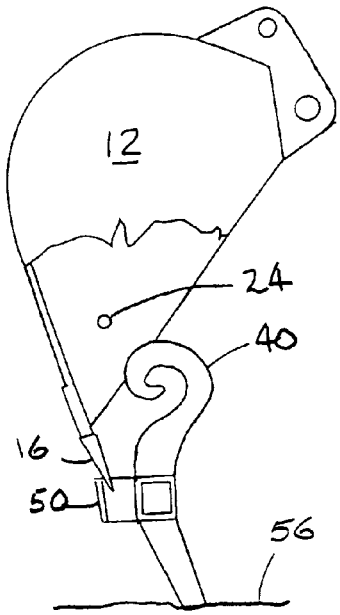
FIG. 4 shows the secondary implement of FIG. 2 as it appears when positioned for connecting with the primary implement of FIG. 1.

FIG. 4 shows bucket 12 raised and curled downward relative to the previous position of FIG. 3, with teeth 16 still engaging pockets 50, so that connecting bosses 24 are positioned above and forward of connecting hooks 40. From this position, bucket 12 is lowered until the relief gaps 18, shown in FIG. 1, bottom out on pockets 50 and connecting bosses 24 are below hook points 48, aligned with hook openings 42, as shown below.

Figure 5:
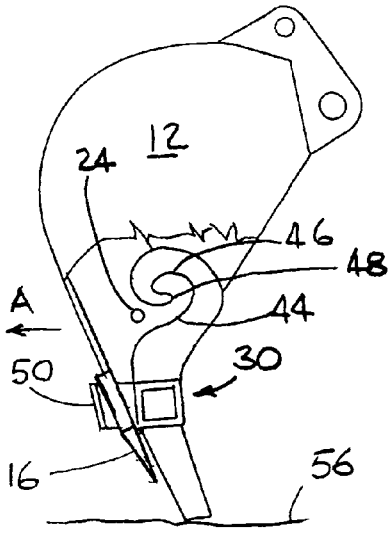
FIG. 5 shows the secondary implement of FIG. 2 as it appears at the intermediate stage of connecting with the primary implement of FIG. 1

When bucket 12 and attachment 30 are positioned as shown in FIG. 5, the operator simply inches the machine forward in direction A from the shown position. This causes connecting bosses 24 to slide over ramps 44 and pass points 48.

Figure 6:
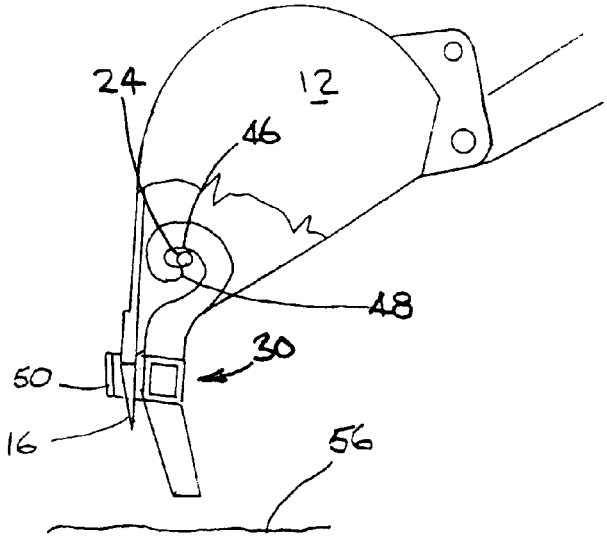
FIG. 6 shows the secondary implement of FIG. 2 and the secondary implement of FIG. 2 as they appear when connected.

FIG. 6 shows how bucket 12 is raised slightly to settle connecting bosses 24 into hook seats 46 and how inwardly curved points 48 prevent disengagement in a generally vertical direction. The engagement of teeth 16 in pockets 50 serves to retain attachment 30 in a generally vertical orientation, once connected.

Figure 7:
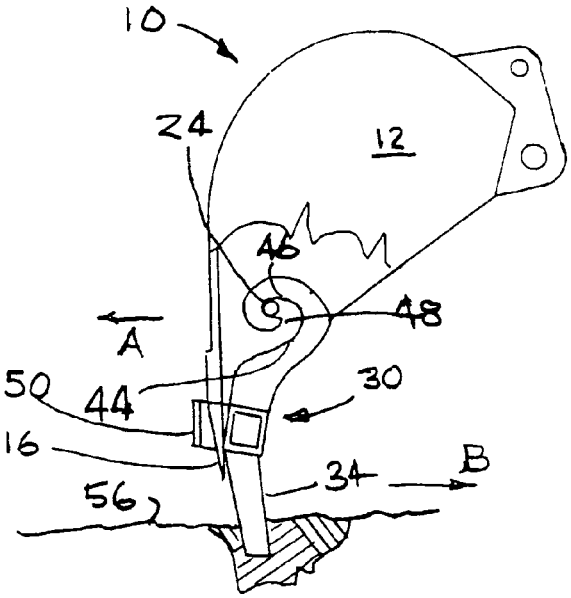
FIG. 7 shows the connection of secondary implement of FIG. 2 as appears when working under load.

FIG. 7 shows attachment 30 connected to primary implement 10, or bucket 12, as previously described, and how connecting bosses 24 are supported by extended points 48 support the attachment and prevent generally vertical disengagement thereof. When connecting bosses 24 are trapped in open hooks 40, they can be released only by first applying a rearward moment force at picks 34 (counter-clockwise in this view) by engaging picks 34 lightly with ground 56 and then, inching the machine forward in direction A, lowering bucket 12 to again bottom out reliefs 18 on pockets 50, and then inching the machine backward in the direction of arrow B and raising bucket 12, allowing gravity to release attachment 30. Unless applied in this sequence and direction, forces acting on attachment 20 during work operations will not disengage the connection.

As bucket 12 moves rearward when working in the direction of arrow B, the working force against picks 34 thrust connecting bosses 24 deep into seats 46, where they can exert downward force on points 48, and press picks 34 against ground 56. By taking care that upward forces on picks 34 are relatively small, picks 34 can also rake the opposite direction. This view also shows how connecting bosses 24 bear against the forward side of hook seats 46 under rearward working forces.

Figure 8:
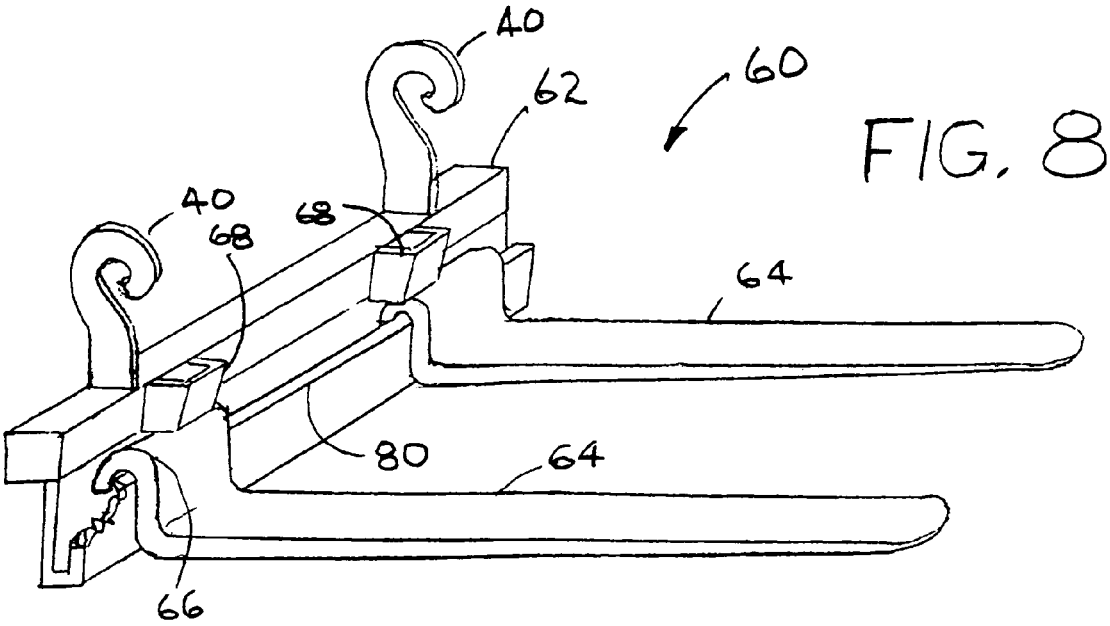
FIG. 8 shows an alternative embodiment in the form of a fork lift attachment as the secondary implement.

FIG. 8 shows an alternative secondary implement as fork lift attachment 60. Connecting hooks 40 are as previously described and lateral member 62 is only as long as needed for adjusting the placement of fork lift blades 64. Blades 64 have "U" shaped ends 66 that fit over the edge of fork lift blade track 80 so as to support lifting pallets and the like while still being readily moved for width adjustment. Pockets 68 are fitted to the face of lateral member 62 SO that the connection of fork lift attachment 60 is performed much as previously described for attachment 30, other than that the step of positioning the open hooks 40 to extend upwardly, as described under FIGS. 3 & 4, is accomplished by the inherent nature of attachment 60 when blades 64 are in place, thereby not requiring this initial operation. When attachment 60 is in use, it can be seen that loads carried on blades 64 will exert a moment causing connecting bosses 24 to bear against the rearward side of hook seats 46.

Thus, a machine operator may attach and use a secondary implement for work operations involving either forward or rearward moment forces, as illustrated by rake attachment 30 and fork lift attachment 30.

The embodiments shown and described above are exemplary. It is not claimed that all of the details, parts, elements, or steps described and shown were invented herein. Even though many characteristics and advantages of the present inventions have been described in the drawings and accompanying text, the description is illustrative only. Changes may be made in the detail, especially in matters of shape, size, and arrangement of the parts within the scope and principles of the inventions. The restrictive description and drawings of the specific examples above do not point out what an infringement of this patent would be, but are to provide at least one explanation of how to use and make the inventions. The limits of the inventions and the bounds of the patent protection are measured by and defined in the following claims.

I claim:

1. Apparatus for enabling a machine operator to connect an attachment to an earth moving machine without operator assistance from on the ground including an operator positionable bucket having an open face with a bucket edge and side walls, comprising:

a symmetrical pair of axially aligned and horizontally opposite connecting bosses mounted on the side walls;

a tooth member extending from the bucket edge;

an attachment for connection to the machine, the attachment including a lateral structural member with an implement extending downwardly therefrom, the implement having a forward direction and a rearward direction;

a pair of spaced apart open hooks extending upwardly from the lateral structural member, the openings thereof facing the forward direction and being made to engage the connecting bosses, with each open hook including a ramp portion leading from the open face to a seat, an inwardly curved point extending back toward the ramp portion, and opposing the seat, so that the seats engage the connecting bosses when the attachment is connected and the inwardly curved, extended points support the attachment and prevent generally vertical disengagement thereof; and at least one pocket, mounted on the forward surface of the lateral member and is located to loosely engage the extended tooth member so that the open hook can receive the boss and then maintain the attachment in a generally vertical orientation, when the bosses and open hooks connect the attachment to the bucket.

2. The apparatus of claim 1 wherein the attachment is a rake or scarifying attachment.

3. The apparatus of claim 1 wherein the attachment is a fork lift attachment.

4. The apparatus of claim 1 wherein the attachment is a smoothing blade.

5. A method for connecting an attachment to an earth moving machine having a bucket, without operator assistance from on the ground, comprising the steps of:

mounting a symmetrical pair of axially aligned and horizontally opposite connecting bosses on the bucket;

providing an attachment having a pocket and a pair of extending hooks, each hook including an open face, a ramp portion leading from the open face to a seat portion and an inwardly curved point extending back toward the ramp portion and opposing the seat portion;

positioning the bucket so that a bucket tooth engages the pocket;

maneuvering the bucket to position the attachment so that its hook open faces are in substantial alignment with the connecting bosses;

moving the bucket so that the connecting bosses enter the hook open faces to slide along the hook ramps, past the extended hook points to the seats;

raising the primary implement, to settle the connecting bosses onto the extended hook points to complete the connection;

retaining the connected attachment in a generally vertical orientation by tooth engagement in the pocket; and preventing generally vertical disconnection of the bosses with the extended hook points.

6. The method of claim 5 wherein the secondary attachment is a rake or scarifying attachment.

7. The method of claim 5 wherein the attachment is a fork lift attachment.

8. The method of claim 5 wherein the attachment is a smoothing blade attachment.

* * * * *